US005400440A

United States Patent [19]

Clifford

[11] Patent Number: 5,400,440

[45] Date of Patent: Mar. 28, 1995

[54] NECK AND EAR APPAREL

[76] Inventor: Peter A. Clifford, 640 Unity Rd., Benton, Me. 04927

[21] Appl. No.: 225,770

[22] Filed: Apr. 11, 1994

[51] Int. Cl.[6] ..... A42B 1/06

[52] U.S. Cl. ..... 2/172; 2/209.13

[58] Field of Search ..... 2/7, 172, 181, 181.2, 2/181.4, 175.3, 175.6, 195.1, 207, 209.3, 209.13, 909, 916, 918, DIG. 11

[56] References Cited

U.S. PATENT DOCUMENTS

| | | | |
|---|---|---|---|
| 4,180,868 | 1/1980 | Snow | 2/172 |
| 5,046,195 | 9/1991 | Koritan | 2/172 |
| 5,153,943 | 10/1992 | Clement | 2/172 |
| 5,161,259 | 11/1992 | Shorts | 2/172 |

*Primary Examiner*—Clifford D. Crowder
*Assistant Examiner*—Diana L. Biefeld
*Attorney, Agent, or Firm*—Frederick R. Cantor

[57] ABSTRACT

A flat flexible fabric sheet has opposite side edges attached to an elastic band to form a hood-like fabric shield for a person's ears and neck. The fabric sheet and elastic band form an expansible annulus for attaching the sheet to a person's cap, such that when the cap is worn the fabric sheet hangs down from the cap's lower edge to cover the person's ears and neck. The lower corners of the fabric sheet are curved to minimize interference between the sheet and the person's collar, as might interfere with desired gravitational positionment of the fabric. The elastic band has a narrow width so that the band is easily stretched to enable the apparel item to fit a range of different size caps.

1 Claim, 1 Drawing Sheet

NECK AND EAR APPAREL

BACKGROUND OF THE PRESENT INVENTION

1. Field of the Invention

The present invention relates to an item of neck and ear apparel.

The present invention, more particularly relates to an item of apparel attachable to a person's cap for covering the person's ears and neck.

2. Prior Developments

U.S. Pat. No. 5,153,943, issued to K. Clement, discloses an item of wearing apparel, designed to be attached to a person's cap for covering the person's ears and neck. A flexible fabric shield is attached to an elastic headband to form an elastic ring structure suitable for placement around the person's cap. When the ring structure is in place on the cap, the fabric shield hangs down to cover the person's neck and ears.

At the front edges of the fabric shield there are two mating patches of hook-and-loop fastening materials, such that the edges of the fabric material can be brought together so as to cover the person's chin. The shield, thereby, more completely, or effectively, covers the person's neck area to provide added protection against the weather elements.

One problem with the item of apparel depicted in the Clement patent is that the fabric shield is elongated in the vertical direction, so that the lower portion of the fabric shield rests against the person's back and shoulders. The fabric material can be at least partially supported by the person's back and/or shoulders so that the fabric does not hang freely around the person's ears. The fabric material may be slightly spaced away from the person's ears, such that the fabric puckers and fails to fully protect the ears from the weather elements.

Another drawback of the construction of U.S. Pat. No. 5,153,943 is that the elastic band is relatively wide, typically about one inch. The wide elastic band tends to cover up the front portion of the person's cap, thereby obscuring or concealing any insignia or emblem that might be printed on the cap. Some people might avoid purchasing or wearing the protective item because of the negative esthetic effect that might result.

The relatively wide headband is also disadvantageous in that it tends to be relatively stiff and unnecessarily tight on the person's cap. The headband elasticity is a desirable feature in that it enables the apparel item to fit a range of different cap sizes. However, a relatively stiff, or high modulus elastic band, will tend to compress the cap material when it is expanded to fit the larger cap sizes. It would be desirable to be able to use a headband that has a greater flexibility and a lesser compressive force on the cap material.

A further drawback of the structure of U.S. Pat. No. 5,153,943, is that it is relatively expensive, due to the amount of fabric material used, and the employment of various adjustment devices added to the fabric to promote a satisfactory fit on a range of different cap sizes.

SUMMARY OF THE PRESENT INVENTION

An object of the present invention is to provide an item of neck and ear apparel.

A further object of the present invention is to more particularly provide a relatively inexpensive item of apparel attachable to a person's cap for covering the person's ears and neck.

In the wintertime the item of apparel provides protection against the weather elements, i.e., cold and snow. In the summertime the item of apparel provides protection against sun, wind, rain and insects.

In its preferred form, the invention is embodied in a single flexible sheet having a linear upper edge, two side edges, a bottom edge, and two arcuate edges joining the bottom edge to the side edges. A single elastic band has its opposite ends attached to the upper corners of the flexible sheet, whereby the sheet and elastic band form an endless elastic ring structure that can be placed around a person's cap.

The flexible sheet has a vertical length, such that its bottom edge is slightly below the level of the person's chin. The fabric therefore hangs freely from the lower edge of the person's cap so that side areas of the sheet lie closely against the person's ears. The arcuate lower edges of the sheet minimize any interference that might otherwise exist between the fabric and the person's collar, thereby promoting a good fit of the fabric on the person's ears.

The elastic band connecting the front corners of the fabric sheet is relatively narrow, typically only about one-quarter ($\frac{1}{4}$) inch, so that the band has a low modulus of elasticity. The band can thereby be readily expanded to conform the apparel item to a range of different cap sizes. Typically, the narrow elastic band has a normal length of about seven (7) inches and an expanded length of about twelve (12) or thirteen (13) inches. The elastic band can thus be used as an adjustment device to adapt the apparel item to a wide range of cap sizes. No other adjusting mechanism is required.

The narrow elastic band is further advantageous in that it is relatively inconspicuous on the front face of the cap. The band is thus less likely to obscure or conceal any emblems or insignias on the cap front surface.

In summary, and in accordance with the above discussion, the foregoing objectives are achieved in the following embodiments.

1. An item of apparel adapted to be attached to a cap worn by a person so that the item of apparel covers the person's ears and neck; said item of apparel comprising:

a single flexible sheet having a linear upper edge, two side edges, a bottom edge, and two arcuate edges joining said bottom edge to said side edges;

a single elastic band having opposite ends thereof attached to the side edges of said flexible sheet, such that the upper edge of said sheet is enabled to extend around the rear surface and side surfaces of a person's cap while the elastic band extends across the front surface of the person's cap, whereby the item of apparel is suspended from the person's cap;

said flexible sheet having a vertical centerline located equidistant from said side edges; each arcuate edge being centered on a point located near said vertical centerline a relatively short distance below said upper edge, whereby each arcuate edge has a substantial radius of curvature measured from said point;

the vertical distance between the sheet upper edge and lower edge being substantially less than the distance between the side edges, such that when the item of apparel is worn on a person's cap said bottom edge is slightly below the elevation of the person's chin; and said elastic band having a width dimension and a length dimension; the width dimension of said elastic band being no more than about one-quarter ($\frac{1}{4}$) inch, so that the band is easily stretched to adapt the apparel item to a range of different size caps; said elastic band having its opposite ends connected to said flexible sheet at connection points spaced below the sheet upper edge, whereby the flexible sheet has a substantial overlap on the cap.

2. The item of apparel as described in paragraph 1, and further comprising detachable connections between the ends of said elastic band and said flexible sheet; and each detachable connection comprising a patch of adhesive fibrous material attached to the flexible sheet, and a mating patch of fibrous material attached to the elastic band.

A BRIEF DESCRIPTION OF THE DRAWINGS

DESCRIPTION OF THE PREFERRED EMBODIMENT OF THE PRESENT INVENTION

Figure 1:
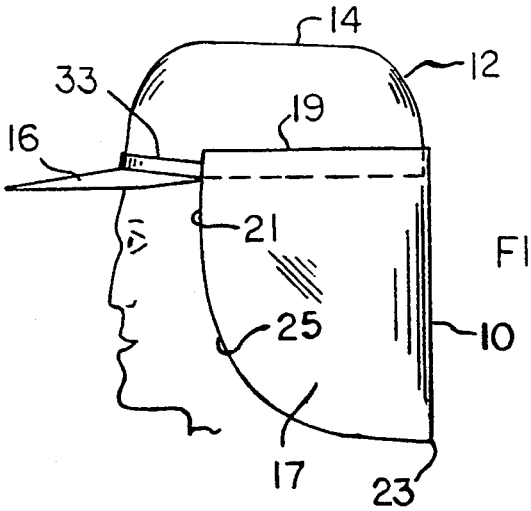
FIG. 1, is a side view of an item of apparel embodying the present invention. The apparel item is shown installed on a person's cap.

FIG. 1, is a side view of an item of apparel embodying the present invention. The apparel item is shown installed on a person's cap.

FIG. 1, shows an apparel item 10, installed on a person's cap 12. The cap 12 is a conventional head covering, that includes a flexible cup-shaped fabric portion 14 and a visor (or bill) 16. Apparel item 10, comprises a single flexible fabric sheet 17, having a linear upper edge 19, two side edges 21, a bottom edge 23, and two arcuate edges 25, joining bottom edge 23 to respective ones of side edges 21. Each arcuate edge 25 is centered on an imaginary point 27, located relatively close to the sheet centerline 29.

The upper corners of 31, of the flexible fabric sheet 17, are interconnected by a single elastic band 33, such that the fabric sheet 17 and elastic band 33 collectively form an expansible annulus, or ring, adapted for placement around cap portion 14, as shown in FIG. 1. Apparel item 10, is installed on the person's cap 12 so that fabric sheet 17, has its upper edge area 19 overlapped onto the lower edge of cap 12; elastic band 33, extends across the front surface of the cap just above visor 16. The elasticity of band 33, holds the apparel item 10 in place on the cap 12, such that the upper edge 19 area of fabric sheet 17 has a reasonably tight fit on the cap 12 (without collapsing or deforming the cap).

Apparel item 10, can have some variation in size and shape. Typically, fabric sheet 17, will have a width dimension 35, measuring about thirteen (13) and one-half ($\frac{1}{2}$) inches, and a vertical length dimension 37, measuring about eight (8) and one-half ($\frac{1}{2}$) inches. The radius of curvature 39, of each arcuate edge 25, measures about five (5) inches. Elastic band 33, has a preferred length dimension measuring about seven (7) inches; the width dimension 36 of the elastic band is no more than about one-quarter ($\frac{1}{4}$) inch, such that the band is relatively inconspicuous on the person's cap.

Because elastic band 33, has a relatively small width, it can be made to have a relatively small elasticity resistance (low modulus of elasticity). The elastic band 33 can be elongated from its normal length of seven (7) inches to an expanded length of about thirteen (13) inches, with a tension force of about twenty-four (24) ounces (i.e., four (4) ounces per inch extension). The relatively low modulus of elasticity is advantageous in that the band can be appreciably expanded to fit a wide range of cap sizes without collapsing or deforming the cap. This is apparently not the case with the headband used in the construction of U.S. Pat. No. 5,153,943. In that patented arrangement, various auxiliary straps and hook-and-loop adhesive patches are used to adapt the apparel item to a range of different cap sizes. With the construction shown herein the narrow elastic band 33 is, by itself, capable of adjusting the apparel item 10 to a wide range of cap sizes.

Elastic band 33, is attached to fabric sheet 17, at points slightly below the sheet upper edge 19. The spacing 41, of the band from upper edge 19, will typically be about one-quarter ($\frac{1}{4}$) inch. By spacing the elastic band 33 below edge 19, the line of action of the elastic force will be offset below edge 19. When the apparel item 10 is installed on a person's cap 12 the elastic force of band 33, will tend to maintain the overlap between the upper edge 19 area of fabric sheet 17, and the lower edge area of the cap 12. The apparel item 10 will retain itself on the cap 12, without tending to slip or fall off.

The vertical length 37 of fabric sheet 17, is such that when the apparel item 10 is worn on the person's cap 12 the bottom edge 23, of the fabric sheet 17 is slightly below the level (or elevation) of the person's chin, as depicted in FIG. 1. The fabric sheet 17 hangs freely, without receiving support from the person's collar or shoulders. As a result, the fabric sheet 17 lies close against the person's ears so as to provide against air flow into or out of the space within the fabric shield. Arcuate edge 25, is advantageous in this regard, in that it removes portions of the fabric sheet that might otherwise come into contact with the person's collar so as to produce outward puckering, or buckling, of the fabric away from the person's ear.

Figure 2:
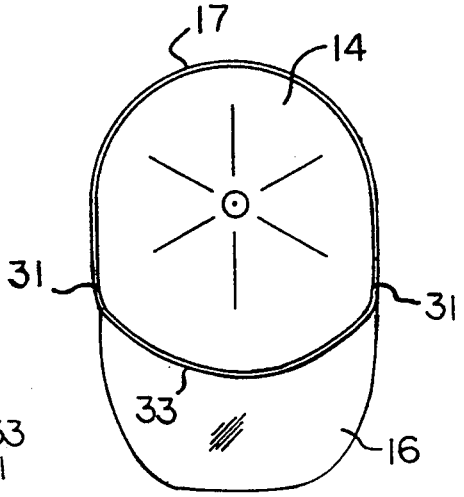
FIG. 2, is a top plan view of the apparel item and cap shown in FIG. 1.

FIG. 2, is a top plan view of the apparel item and cap shown in FIG. 1.

Figure 3:
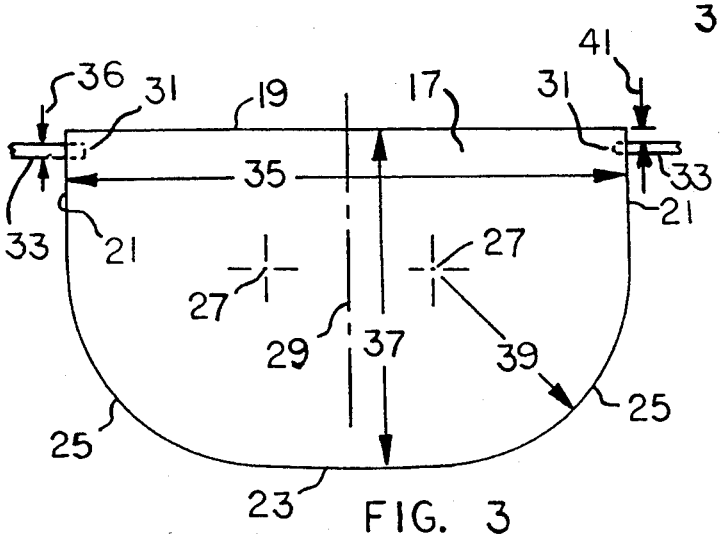
FIG. 3, is a plan view of a fabric sheet used in the FIG. 1, apparel item.

FIG. 3, is a plan view of a fabric sheet used in the FIG. 1, apparel item.

The fabric sheet configuration depicted in FIG. 3, provides a fabric covering that closely conforms to a person's anatomy so as to offer reasonably good weather and insect protection for the person's ears and neck.

Figure 4:
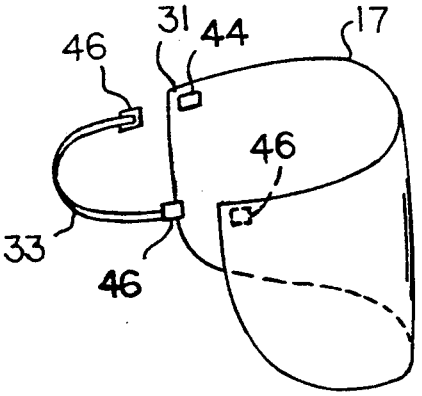
FIG. 4, is an exploded perspective view of another construction embodying the invention.

FIG. 4, is an exploded perspective view of another construction embodying the invention.

Figure 5:
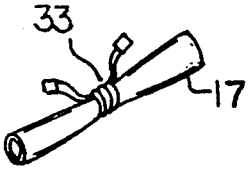
FIG. 5, is another view of the FIG. 4 construction, shown in a rolled-up condition suitable for storage or disposition in a person's purse or pocket.

FIG. 5, is another view of the FIG. 4 construction, shown in a rolled-up condition suitable for storage or disposition in a person's purse or pocket.

FIGS. 4 and 5, illustrate a variant of the present invention wherein the elastic band 33, has detachable connections with fabric sheet 17. Patches 44, of adhesive hook-and-loop material are stitched to corner areas 31, of sheet 17. Mating patches 46, of adherent hook-and-loop material are attached to the ends of elastic band 33. The mating patch 46 material, may be the material marketed under the tradename VELCRO, or a similar suitable material.

When it is desired to install the apparel item 10 on a person's cap 12, the adherent patches 44 and 46, are pressed together to attach elastic band 33, to fabric sheet 17. The apparel item 10 can then be installed on the person's cap 12, in the same fashion as the apparel item 10 of FIG. 1.

By separating the adhesive patches 44 and 46, it is possible to detach elastic band 33, from fabric sheet 17. The fabric sheet 17 can then be rolled up, or folded, into a relatively compact bundle, as shown, e.g., in FIG. 5. Band 33, can be wrapped around the bundle and tied to keep the bundle shape. This feature enables the apparel item 10 to be stored in a person's purse or pocket for ready access when needed.

The apparel item has been described in conjunction with its use on a person's cap. However, the item of apparel can also be used without the cap, i.e., as a shield for the neck and ears of a bareheaded person. The apparel item can be applied to various types of headwear, e.g., hard hats, hoods, helmets, etc..

The present invention, described above, relates to NECK AND EAR APPAREL. Features of the present invention are recited in the appended claims. The drawings contained herein necessarily depict structural features and embodiments of the NECK AND EAR APPAREL, useful in the practice of the present invention.

However, it will be appreciated by those skilled in the arts pertaining thereto, that the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An item of apparel adapted to be attached to a cap worn by a person so that the item of apparel covers the person's ears and neck, said item of apparel comprising:

a single flexible sheet having a linear upper edge, two linear side edges normal to said upper edge, a linear bottom edge, and two arcuate edges joining said bottom edge to said side edges;

a single elastic band having opposite ends thereof releasably attached to the side edges of said flexible sheet, such that the upper edge of said sheet is enabled to extend around the rear surface and side surfaces of a person's cap while the elastic band extends across the front surface of the person's cap, whereby the item of apparel is suspended from the person's cap;

said flexible sheet having a vertical centerline located equidistant from said side edges;

each arcuate edge being centered on a point located near said vertical centerline a relatively short distance below said upper edge, whereby each arcuate edge has a substantial radius of curvature measured from said point;

the vertical distance between the sheet upper edge and bottom edge being substantially less than the distance between the side edges, such that when the item of apparel is worn on a person's cap said bottom edge is slightly below the elevation of the person's chin;

said elastic band having a width dimension and length dimension;

the width dimension of said elastic band being no more than about one-quarter ($\frac{1}{4}$) inch so that the band is easily stretched to adapt the apparel item to a range of different size caps;

said elastic band having its opposite ends connected to said flexible sheet at connection points proximate to said side edges and spaced a significant distance below the sheet upper edge, whereby the flexible sheet has a substantial overlap on the cap;

detachable connections between the ends of said elastic band and said flexible sheet;

each detachable connection comprising a patch of adhesive fibrous material attached to the flexible sheet, and a mating patch of fibrous material attached to the elastic band; and said flexible sheet being dimensioned so that when the item of apparel is worn on a person's cap, the two linear side edges of said sheet are located forwardly from the person's ears, whereby areas of the sheet proximate to said arcuate edges cover the person's ears without buckling of the sheet material.

* * * * *